US011131149B2

(12) United States Patent
Mueller et al.

(10) Patent No.: US 11,131,149 B2
(45) Date of Patent: Sep. 28, 2021

(54) TRANSMISSION LINE FOR WIRED PIPE

(71) Applicants: Stephan Mueller, Celle (DE); Volker Krueger, Celle (DE); Christian Fulda, Lower Saxony (DE); Ingo Roders, Seelze (DE); Henning Rahn, Niedersachsen (DE)

(72) Inventors: Stephan Mueller, Celle (DE); Volker Krueger, Celle (DE); Christian Fulda, Lower Saxony (DE); Ingo Roders, Seelze (DE); Henning Rahn, Niedersachsen (DE)

(73) Assignee: BAKER HUGHES VENTURES & GROWTH LLC, Oklahoma City, OK (US)

( * ) Notice: Subject to any disclaimer, the term of this patent is extended or adjusted under 35 U.S.C. 154(b) by 0 days.

(21) Appl. No.: 16/600,177

(22) Filed: Oct. 11, 2019

(65) Prior Publication Data

US 2020/0040664 A1 Feb. 6, 2020

Related U.S. Application Data

(62) Division of application No. 13/687,563, filed on Nov. 28, 2012, now Pat. No. 10,443,315.

(51) Int. Cl.
*H01B 13/00* (2006.01)
*E21B 17/00* (2006.01)
(Continued)

(52) U.S. Cl.
CPC ..... *E21B 17/003* (2013.01); *E21B 17/028* (2013.01); *H01B 13/264* (2013.01); *Y10T 29/49117* (2015.01)

(58) Field of Classification Search
CPC combination set(s) only.
See application file for complete search history.

(56) References Cited

U.S. PATENT DOCUMENTS 1,952,319 A * 3/1934 Hull ..... B23K 9/0253 219/60 R
3,452,434 A * 7/1969 Wagele ..... G06F 3/002 29/872

(Continued)

FOREIGN PATENT DOCUMENTS

EP 1094194 A2 4/2001
GB 772279 A * 4/1957 ..... B23K 13/046
WO 03097992 A1 11/2003

OTHER PUBLICATIONS

European Search Report for Application No. 14818772.7-1809, dated Jan. 24, 2017, 7 pages.

(Continued)

*Primary Examiner* — William H. Mayo, III
*Assistant Examiner* — Krystal Robinson
(74) *Attorney, Agent, or Firm* — Cantor Colburn LLP

(57) ABSTRACT

A wired pipe system includes a wired pipe segment having a first end and a second end and a first coupler in the first end and a second coupler in the second end. The system also includes a transmission line disposed in the wired pipe segment between the first and second ends. The transmission line includes an inner conductor, an insulating material surrounding the inner conductor, an outer conductor surrounding the insulating material and the inner conductor for at least a portion of a length of the transmission line, the other conductor being formed by deforming around the inner conductor a sheet of material into a substantially tubular member.

10 Claims, 7 Drawing Sheets

(51) Int. Cl.
*E21B 17/02* (2006.01)
*H01B 13/26* (2006.01)

(56) References Cited

U.S. PATENT DOCUMENTS

| | | | | |
|---|---|---|---|---|
| 3,518,608 | A | 6/1970 | Papadopoulos | |
| 4,767,182 | A * | 8/1988 | Parfree | G02B 6/4427 385/107 |
| 4,971,147 | A | 11/1990 | Thomeer | |
| 5,086,196 | A | 2/1992 | Brookbank et al. | |
| 5,122,209 | A | 6/1992 | Moore et al. | |
| 5,745,047 | A | 4/1998 | Van Gisbergen et al. | |
| 5,894,104 | A | 4/1999 | Hedberg | |
| 6,982,384 | B2 | 1/2006 | Hall et al. | |
| 7,086,898 | B2 | 8/2006 | Johnsen et al. | |
| 7,190,280 | B2 * | 3/2007 | Hall | H01R 24/566 340/855.1 |
| 7,224,289 | B2 | 5/2007 | Bausov et al. | |
| 7,325,836 | B2 | 2/2008 | Eckhardt | |
| 8,118,093 | B2 | 2/2012 | Hassell et al. | |
| 8,302,294 | B2 | 11/2012 | Moe | |
| 2002/0053446 | A1 | 5/2002 | Moe et al. | |
| 2002/0075114 | A1 | 6/2002 | Hall et al. | |
| 2002/0182934 | A1 * | 12/2002 | Endo | H01R 4/184 439/578 |
| 2002/0193004 | A1 | 12/2002 | Boyle et al. | |
| 2003/0109862 | A1 | 6/2003 | Prakash et al. | |
| 2003/0236562 | A1 * | 12/2003 | Kuzma | A61N 1/0529 607/122 |
| 2004/0079737 | A1 | 4/2004 | Pinchasik | |
| 2004/0118590 | A1 * | 6/2004 | Head | H01R 13/533 174/105 R |
| 2004/0118591 | A1 * | 6/2004 | Bufanda | H01B 11/1808 174/106 R |
| 2004/0149471 | A1 | 8/2004 | Hall et al. | |
| 2004/0150532 | A1 | 8/2004 | Hall et al. | |
| 2004/0177956 | A1 | 9/2004 | Boyadjielf | |
| 2005/0118848 | A1 | 6/2005 | Hall | |
| 2005/0145406 | A1 | 7/2005 | Hall et al. | |
| 2006/0021799 | A1 | 2/2006 | Hall et al. | |
| 2007/0169929 | A1 | 7/2007 | Hall et al. | |
| 2007/0216159 | A1 * | 9/2007 | Yoshihara | F16L 13/02 285/288.1 |
| 2008/0106433 | A1 | 8/2008 | Madhavan et al. | |
| 2009/0203258 | A1 * | 8/2009 | Guenther | H01R 24/58 439/587 |
| 2010/0089584 | A1 * | 4/2010 | Burns | H01C 3/00 166/302 |
| 2010/0108382 | A1 | 5/2010 | Ma et al. | |
| 2010/0111592 | A1 | 5/2010 | Hassell et al. | |
| 2011/0108267 | A1 | 5/2011 | Chaize | |
| 2011/0220408 | A1 * | 9/2011 | Walsh | A61N 1/05 174/75 R |
| 2011/0240372 | A1 | 10/2011 | Davis | |
| 2011/0308807 | A1 | 12/2011 | Spencer | |
| 2012/0138361 | A1 | 6/2012 | Elliott | |
| 2012/0211235 | A1 | 8/2012 | Smith | |
| 2014/0102806 | A1 | 4/2014 | Millet et al. | |
| 2014/0144699 | A1 | 5/2014 | Mueller | |
| 2014/0352941 | A1 | 12/2014 | Mueller | |
| 2015/0000957 | A1 | 1/2015 | Koppe et al. | |
| 2015/0134292 | A1 * | 5/2015 | Ignatowski | B23K 11/0873 702/130 |
| 2018/0202238 | A1 | 7/2018 | Mueller et al. | |
| 2019/0234193 | A1 * | 8/2019 | Fehri | E21B 43/38 |

OTHER PUBLICATIONS

Notification of Transmitall of the International Search Report and the Written Opinion of the International Searching Authority; PCT/US2014/04450; dated Oct. 27, 2014; 18 pages.

Notification of Transmittal of the International Preliminary Report on Patentability and the Written Opinion of the International Searching Authority, or the Declaration; PCT/US2013/071182; dated Jun. 11, 2015, 10 pages.

Notification of Transmittal of the International Search Report and the Written Opinion of the International Searching Authority, or the Declaration; PCT/US2014/039890; dated Sep. 29, 2014, 12 pages.

Notification of Transmittal of the International Search Report and the Written Opinion of the International Searching Authority; PCT/US2014/044507; dated Oct. 27, 2014; 18 pages.

Shah, et al. "Design Considerations for a New High Data Rate LWD Acoustic Telemetry System" SPE 88636. SPE Asia Pacific Oil and Gas Conference and Exhibition held in Perth, Australia, Oct. 18-20, 2004. 7 pages.

* cited by examiner

TRANSMISSION LINE FOR WIRED PIPE

BACKGROUND

During subterranean drilling and completion operations, a pipe or other conduit is lowered into a borehole in an earth formation during or after drilling operations. Such pipes are generally configured as multiple pipe segments to form a "String", such as a drill string or production string. As the string is lowered into the borehole, additional pipe segments are coupled to the string by various coupling mechanisms, such as threaded couplings.

Pipe segments can be connected with tool joints that include a threaded male-female configuration often referred to as a pin-box connection. The pin-box connection includes a male member, i.e., a "pin end" that includes an exterior threaded portion, and a female member, i.e. a "box end", that includes an interior threaded portion and is configured to receive the pin end in a threaded connection Various power and/or communication signals may be transmitted through the pipe segments via a "wired pipe" configuration. Such configurations include electrical, optical or other conductors extending along the length of selected pipe segments. The conductors are operably connected between pipe segments by a variety of coupling configurations.

Some wired pipe configurations include a transmission device mounted on the lip of the pin as well as in the box end. The transmission device, or "coupler," can transmit power, data or both to an adjacent coupler. The coupler in the pin end might be connected via a coaxial cable to the coupler in the box end.

BRIEF DESCRIPTION

Disclosed herein is wired pipe system that includes a wired pipe segment having a first end and a second end and a first coupler in the first end and a second coupler in the second end. The system also includes a transmission line disposed in the wired pipe segment between the first and second ends that includes an inner conductor, an insulating material surrounding the inner conductor and an outer conductor surrounding the insulating material and the inner conductor for at least a portion of a length of the transmission line, the outer conductor being formed by deforming around the inner conductor a sheet of material into a substantially tubular member.

Also disclosed is a method of forming a wired pipe transmission line that includes: providing an assembly that includes an inner conductor surrounded by an insulating material; providing a sheet of rigid material; deforming the sheet around the insulating material such that a gap exists between the edges of the sheet; and welding the edges together to form a substantially tubular outer conductor.

Also disclosed is a method of forming a wired pipe transmission line that includes: providing art assembly that includes an inner conductor surrounded by an insulating material; providing a sheet of rigid material; deforming the sheet partially around the insulating material; compressing the insulating material with a push pin; and welding, after compressing, the edges together to form a substantially tubular outer conductor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

Figure 1:
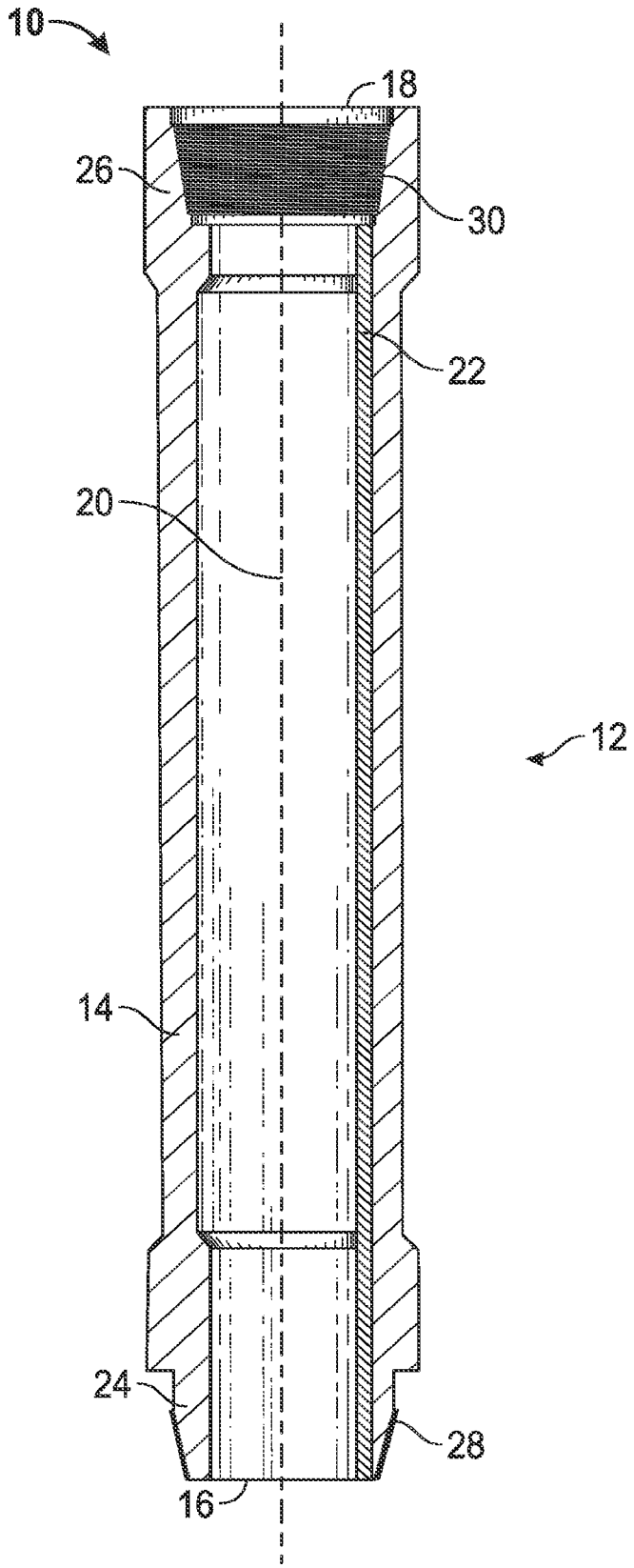
FIG. 1 depicts an exemplary embodiment of a wired pipe segment of a well drilling and/or logging system.

Referring to FIG. 1, an exemplary embodiment of a portion of a well drilling, logging and/or production system 10 includes a conduit or string 12, such as a drillstring or production string, that is configured to be disposed in a borehole for performing operations such as drilling the borehole, making measurements of properties of the borehole and/or the surrounding formation downhole or facilitating gas or liquid production.

For example, during drilling operations, drilling fluid or drilling "mud" is introduced into the string 12 from a source such as a mud tank or "pit" and is circulated under pressure through the string 12, for example via one or more mud pumps. The drilling fluid passes into the string 12 and is discharged at the bottom of the borehole through an opening in a drill bit located at the downhole end of the string 12. The drilling fluid circulates uphole between the string 12 and the borehole wall and is discharged into the mud tank or other location.

The string 12 may include at least one wired pipe segment 14 having an uphole end 18 and a downhole end 16. As described herein, "uphole" refers to a location near the point where the drilling started relative to a reference location when the segment 14 is disposed in a borehole, and "downhole" refers to a location away from the point where the drilling started along the borehole relative to the reference location. It shall be understood that the uphole end 18 could be below the downhole end 16 without departing from the scope of the disclosure herein.

At least an inner bore or other conduit 20 extends along the length of each segment 14 to allow drilling mud or other fluids to flow therethrough. A transmission line 22 is located within the wired segment 14 to provide protection for electrical, optical or other conductors which can be part of the transmission line to be disposed along the wired segment 14. In one embodiment, the transmission line 22 is a coaxial cable. In another embodiment, the transmission line 22 is formed of any manner of carrying power or data, including, for example, a twisted pair. In the case where the transmission line 22 is a coaxial cable it may include an inner conductor surrounded by a dielectric material. The coaxial cable may also include a shield layer that surrounds the dielectric, in one embodiment the shield layer is electrically coupled to an outer conductor that may be formed, for example, by a rigid or semi-rigid tube of a conductive material.

The segment 14 includes a downhole connection 24 and an uphole connection 26. The segment 14 is configured so that the uphole connection 26 is positioned at an uphole location relative to the downhole connection 24. The downhole connection 24 includes a male connection portion 28 having an exterior threaded section, and is referred to herein as a "pin end" 24. The uphole connection 26 includes a female connection portion 30 having an interior threaded section, and is referred to herein as a "box end" 26.

The pin end 24 and the box end 26 are configured so that the pin end 24 of one wired pipe segment 14 can be disposed within the box end 26 of another wired pipe segment 14 to effect a fixed connection therebetween to connect the segment 14 with another adjacent segment 14 or other downhole component. It shall be understood that a wired pipe segment may consist of several (e.g. three) segments. In one embodiment, the exterior of the male coupling portion 28 and the interior of the female coupling portion 30 are tapered. Although the pin end 24 and the box end 26 are described as having threaded portions, the pin end 24 and the box end 26 may be configured to be connected using any suitable mechanism, such as bolts or screws or an interference fit.

In one embodiment, the system 10 is operably connected to a downhole or surface processing unit which may act to control various components of the system 10, such as drilling, logging and production components or subs. Other components include machinery to raise or lower segments 14 and operably couple segments 14, and transmission devices. The downhole or surface processing unit may also collect and process data generated or transmitted by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, a string could be configured as a drillstring hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

Figure 3:
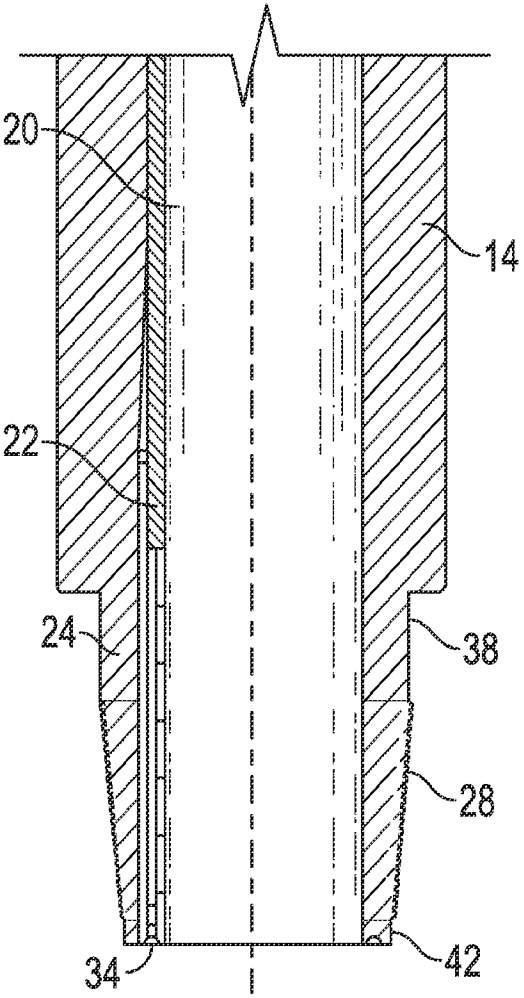
FIG. 3 depicts an exemplary embodiment of a pin end of the segment of FIG. 1.
Figure 2:
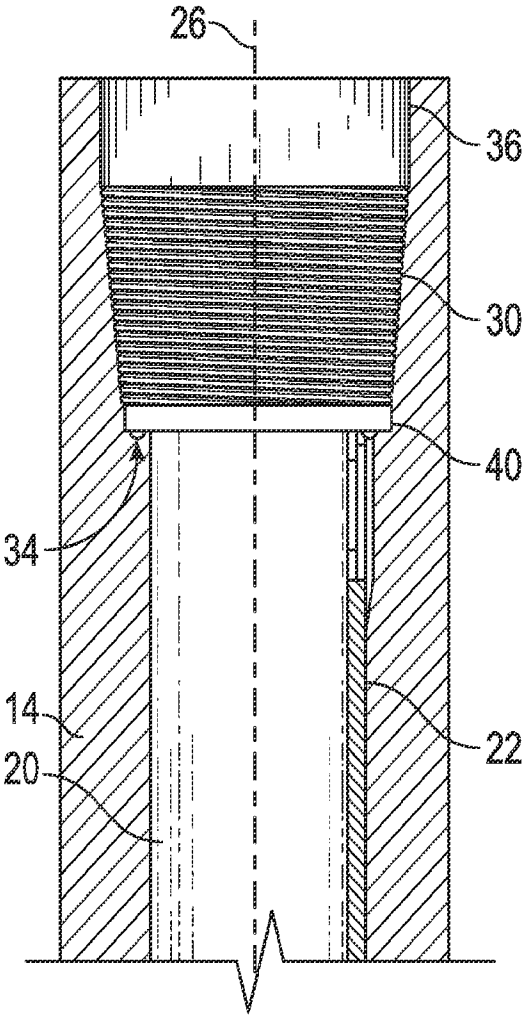
FIG. 2 depicts an exemplary embodiment of a box end of the segment of FIG. 1.

Referring to FIGS. 2 and 3, the segment 14 includes at least one transmission device 34 (also referred to as a "coupler" herein) disposed therein and located at the pin end 24 and/or the box end 26. The transmission device 34 is configured to provide communication of at least one of data and power between adjacent segments 14 when the pin end 24 and the box end 26 are engaged. The transmission device 34 may be of any suitable type, such as an inductive coil capacitive or direct electrical contacts, resonant coupler, or an optical connection ring. The coupler may be disposed at the inner or outer shoulder or in between. It shall be understood that the transmission device 34 could also be included in a repeater element disposed between adjacent segments 14 (e.g., within the box end). In such a case, the data/power is transmitted from the transmission device in one segment, into the repeater. The signal may then be passed "as is." amplified, and/or modified in the repeater and provided to the adjacent segment 14.

Regardless of the configuration, it shall be understood that each transmission device 34 can be connected to one or more transmission lines 22. Regardless of the configuration, it shall be understood that each transmission device 34 can be connected to one or more transmission lines 22. Embodiments disclosed herein are directed how such transmission lines 22 can be formed. In one embodiment, a carrier (either a dielectric surrounded wire or a twisted pair) has a plate of rigid material rolled around it. While one of ordinary skill will realize that several methods can be used to form the particular transmission lines disclosed herein, one approach is to utilize the teachings of U.S. Pat. No. 5,122,209 to form the transmission line.

Figure 4:
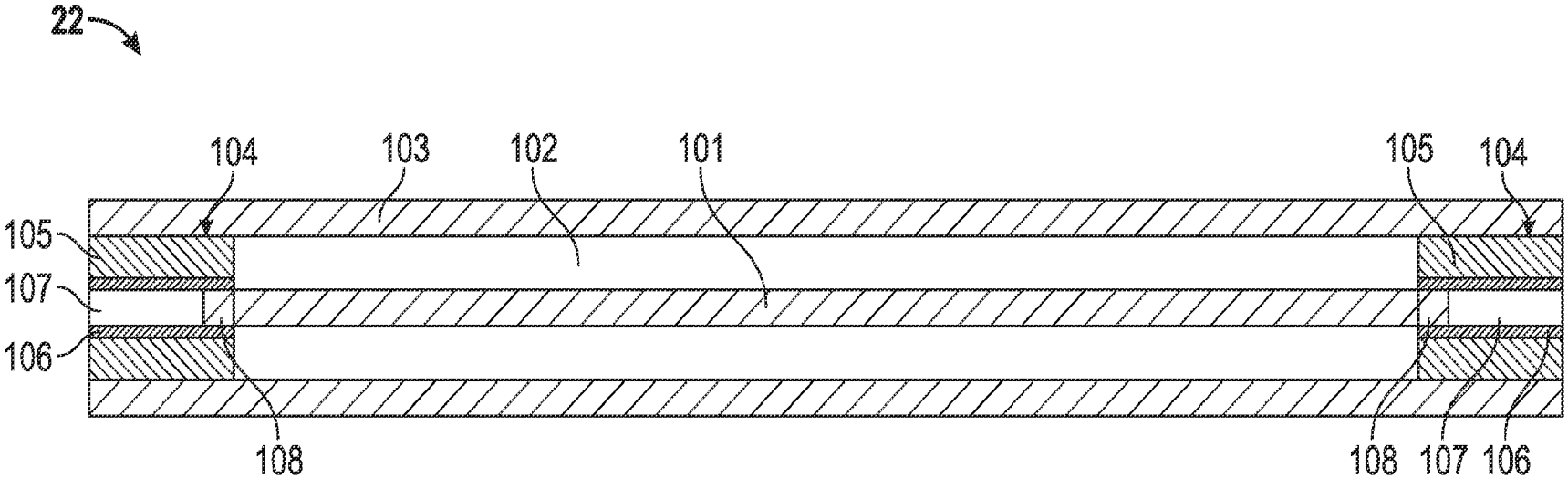
FIG. 4 shows a cut-away side view of a transmission line according to one embodiment.

In more detail, and referring now to FIG. 4, a cut-away side view of a transmission line 22 is illustrated. This embodiment includes an inner conductor 101 that may be formed of a solid or braided metallic wire. An insulating material such as dielectric layer 102 surrounds the inner conductor 101 for most of the length of the inner conductor 101. While not shown it shall be understood that the transmission line 22 can include a shield layer that surrounds the dielectric layer 102. The combination of the dielectric layer 102 and the inner conductor 101 can be formed in any known manner. In one embodiment, the combination is formed such that the dielectric material 102 and the inner conductor 101 are tightly bound.

As illustrated a portion 108 of the inner conductor 101 extend beyond an end of the dielectric layer 102. This portion 108 may be referred to as the inner conductor extension from time to time herein. The inner conductor extension 108 provides a contact point for which an electrical connection to the coupler 34 (FIG. 3) can be made.

The illustrated transmission line 22 includes a connector 104 disposed at the ends of the dielectric layer 102. The connectors 104 serve to provide a means for providing for an electrical connection between the inner conductor 101 and a coupler 34. It shall be understood that the connectors 104 are optional and can be omitted in one embodiment.

The connectors 104 include a conductive region 106 that makes physical and electrical contact with the inner conductor 101. The conductive region 106 could be formed, for example, as a metallic tube. Surrounding the conductive region 106 is an insulating layer 105. The insulating layer 105 can be formed on any type of insulator including, for example, polyether ether ketone (PEEK), ceramic or a dielectric material.

As illustrated an outer conductor 103 surround the inner conductor 101, the dielectric layer 102 and optionally the connectors 104. The outer conductor 103 is deforming a plate of a rigid or semi-rigid conducting material around the inner assembly including the inner conductor 101/dielectric layer 102 and optionally the connectors 104. In one embodiment, the outer conductor 103 is formed of steel.

Figure 5A:
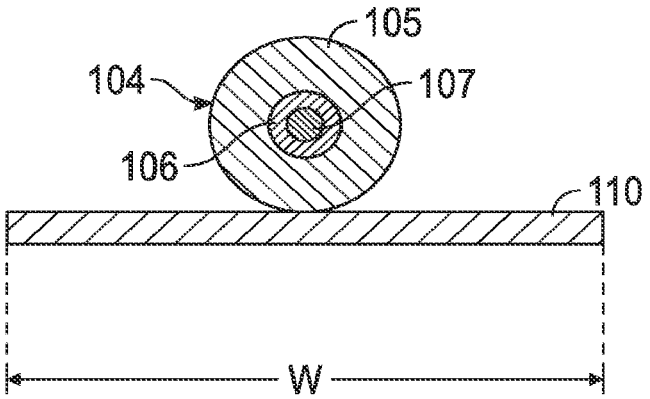
FIGS. 5*a*-5*c* show an example of how an outer conductor can be formed according to one embodiment.
Figure 5B:
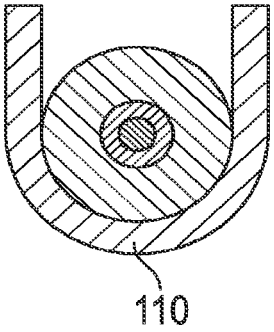
Figure 5C:
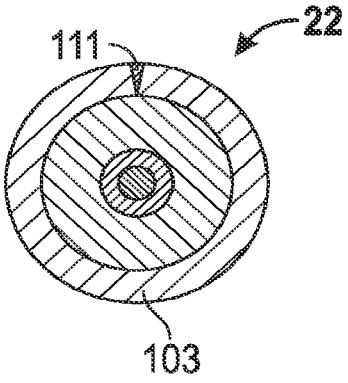

FIGS. 5*a*-5*c* show an end view of transmission line 22 that includes a connector 104. What eventually becomes the outer conductor 103 begins as a sheet 110 of conductive material. According to one embodiment, the sheet 110 has a width, w, that is less than the diameter of the connector 104 and/or the dielectric layer 102 that lies behind it. Of course, this is not required and the width could be greater than the outer diameter of the dielectric layer. The sheet 110 is bent around the connector 104/dielectric layer 102 as shown in FIG. 5*b* and completed so that it substantially surrounds connector 104/dielectric layer 102. As discussed above, in one embodiment, w is less than the outer diameter of connector 104/dielectric layer 102. As such, a gap 111 will exist between edges of the sheet when they are fully deformed around the connector 104/dielectric layer 102 as shown in FIG. 5*c*. The edges are welded together at the location of gap 111 such that the gap 111 becomes a weld joint and the sheet 110 becomes the outer conductor 108 that, in combination with the weld, completely surrounds the connector 104/dielectric layer 102.

In the illustrated embodiment, the sheet 110 is shown being bent around connector 104. It shall be understood that the connector 104 could be omitted and provided at least partially within the outer conductor 103 at a later time.

Figure 6:
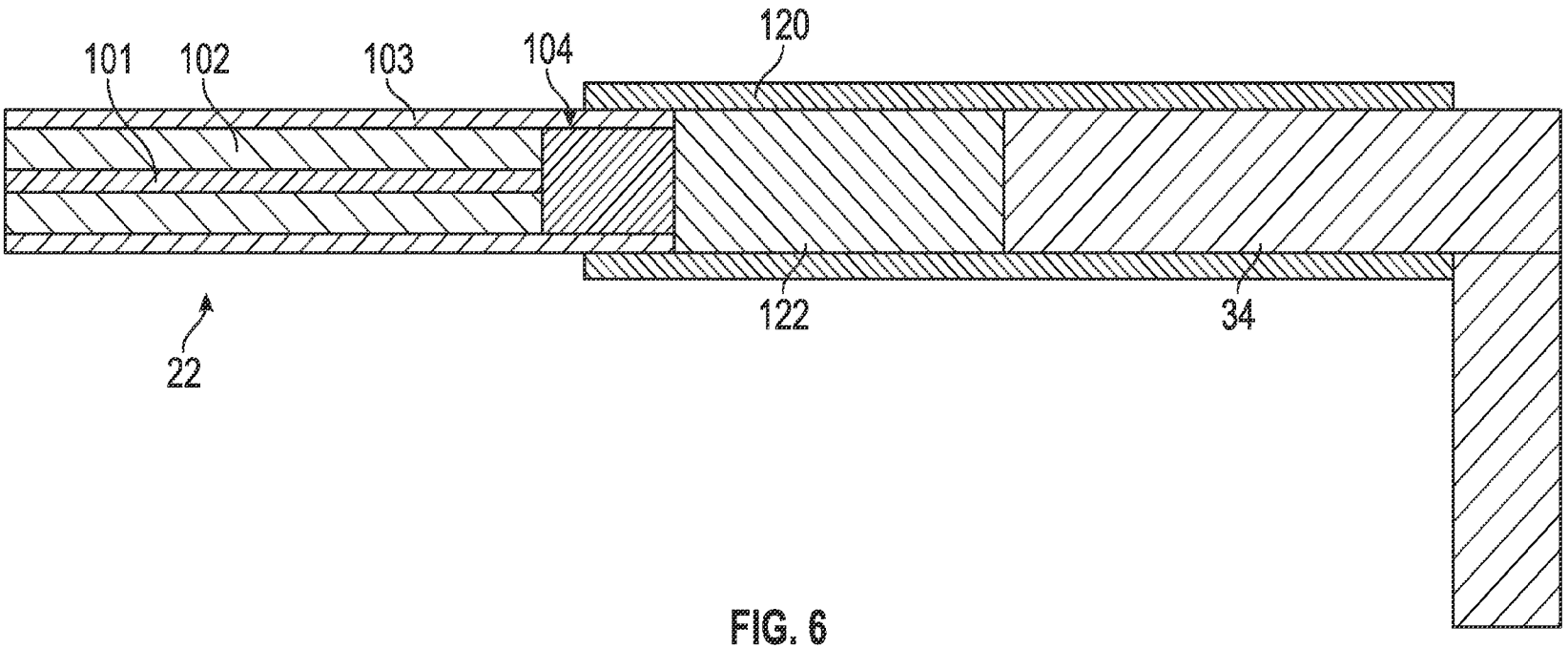
FIG. 6 shows a cut-away side view of a transmission line attached to connectors according to one embodiment.

FIG. 6 illustrates in a cut-away side view a transmission line 22 as described above coupled to an external sleeve 120. The external sleeve 120 can form a sealing cavity in one embodiment. The sleeve 120 can be formed of a conductive material (e.g. steel) and provides rigid frame into which a portion of the coupler 34 and/or a spacer 122 may be inserted and where a seal around that portion may be formed.

Figure 7:
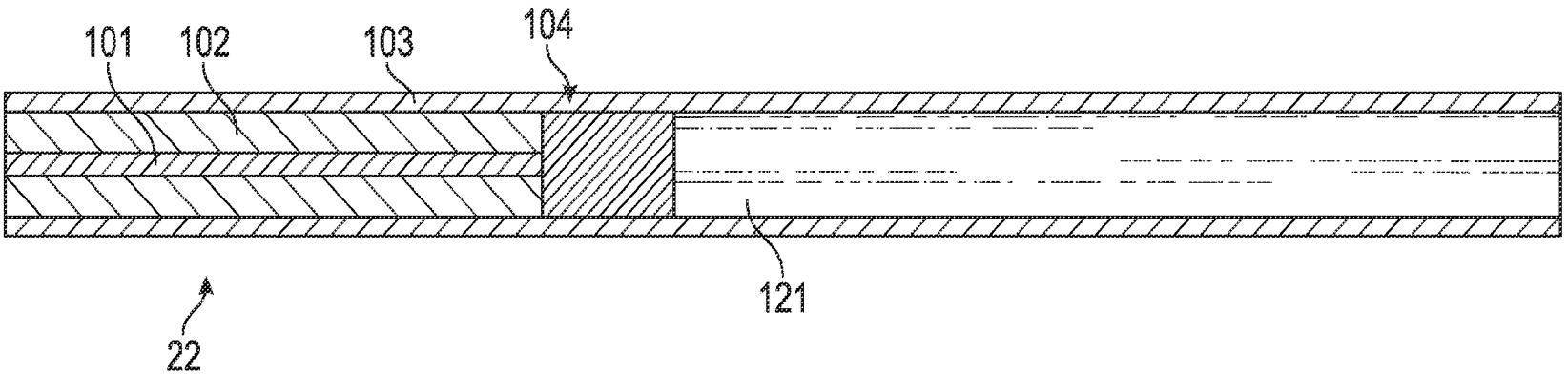
FIG. 7 shows a cut-away side view of a transmission line according to one embodiment.

FIG. 7 shows an alternative embodiment of that shown in FIG. 6. In this embodiment, rather than providing the external sleeve 120, the outer conductor 103 extends beyond the end of the connector 103 to provide a hollow receiving region 121 that serves the same purpose as the sleeve 120 described above. It shall be understood that in any of FIG. 6 or 7 the connector 104 could be omitted.

Figure 8:
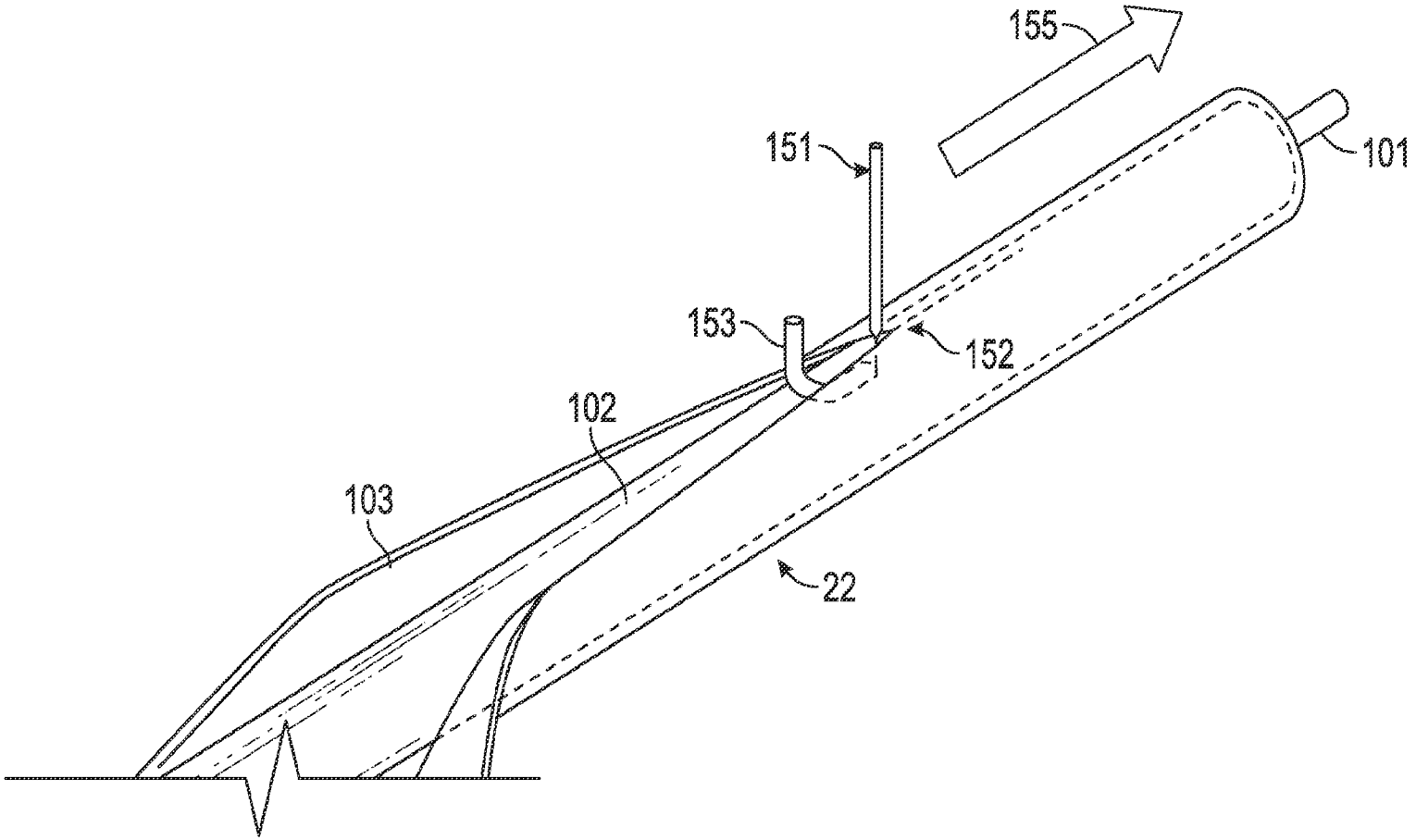
FIG. 8 shows a perspective view a transmission line as it is being formed according to one embodiment.

FIG. 8 illustrates an example of how a transmission line 22 can be formed. In particular, the transmission line 22 includes a dielectric layer 102 and an inner conductor 101 as described above. In this example, the outer conductor 103 is initially formed as a piece of sheet metal. The outer conductor 103 is initially rolled around the dielectric layer 102 as generally described above. While the initial rolling is occurring and before the outer conductor 103 is laser welded together by laser beam 151 at weld line 152, a push pin 153 can cause an interference fit between the dielectric 102 and the outer conductor 103 by pushing down on the dielectric 102. In FIG. 8 the transmission line 22 is being moved in the direction shown by arrow 155 during manufacturing.

Figure 9:
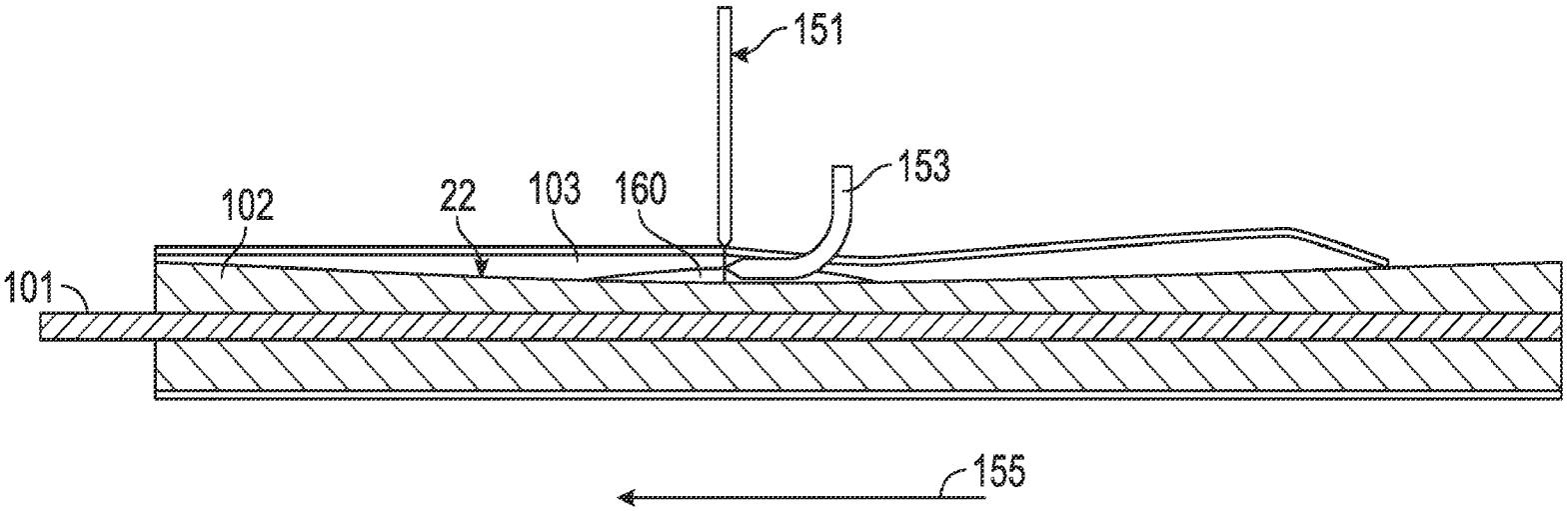
FIG. 9 shows a cut-away side view of die transmission line of FIG. 8 as it is being formed.

Reference is now made to FIG. 9, where the transmission line 22 is being moved in the direction shown by arrow 155. The push pin 153 is compressing the dielectric material 102 to form a space 160 between it and the outer conductor 103. The outer conductor 103 is laser welded by a beam 151 at or near the location where the push pin 153 is compressing the dielectric material 102. As the transmission line 22 is moved in direction 155, the push pin 153 is no longer forming a space between outer conductor 103 and the dielectric material 102. This results in an interference fit between the outer conductor 103 and dielectric material 102. In one embodiment, the interference fit is formed without having to deform the outer conductor 103 after it is formed into a tubular form (e.g., after it is welded).

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of forming a wired pipe transmission line comprising:

providing an assembly that includes an inner conductor surrounded by an insulating material;

providing a sheet of rigid material;

deforming the sheet around the insulating material such that a gap exists between edges of the sheet;

compressing the insulating material with a push pin; and welding the edges together after the compressing to form a substantially tubular outer conductor.

2. The method of claim 1, further comprising:

attaching a connector to an end of the insulating material;

wherein deforming the sheet includes deforming the sheet around the connector.

3. The method of claim 1, wherein an end of the tubular outer conductor extends beyond an end of the insulating material.

4. The method of claim 1, wherein a portion of the inner conductor extends beyond an end of the insulating material.

5. The method of claim 1, wherein an interference fit exists between the insulating material and the sheet before the edges are welded.

6. A method of forming a wired pipe transmitting line comprising:

providing an assembly that includes an inner conductor surrounded by an insulating material;

providing a sheet of rigid material;

deforming the sheet partially around the insulating material;

compressing the insulating material with a push pin; and welding the edges of the sheet together after the compressing to form a substantially tubular outer conductor.

7. The method of claim 6, further comprising:

attaching a connector to an end of the insulating material;

wherein deforming the sheet includes deforming the sheet around the connector.

8. The method of claim 6, wherein an end of the tubular outer conductor extends beyond an end of the insulating material.

9. The method of claim 6, wherein a portion of the inner conductor extends beyond an end of the insulating material.

10. The method of claim 6, wherein an interference fit exists between the insulating material and the sheet before the edges are welded.

* * * * *